US007703501B2

(12) United States Patent
ter Braak

(10) Patent No.: US 7,703,501 B2
(45) Date of Patent: Apr. 27, 2010

(54) DEVICE FOR AUTOMATICALLY MOVING A CURTAIN ALONG A CURTAIN RAIL

(75) Inventor: Bart ter Braak, Doorn (NL)

(73) Assignee: Rolf Edward Goelst, Ad Ede (NL)

( * ) Notice: Subject to any disclaimer, the term of this patent is extended or adjusted under 35 U.S.C. 154(b) by 0 days.

(21) Appl. No.: 10/309,945

(22) Filed: Dec. 3, 2002

(65) Prior Publication Data

US 2003/0106653 A1 Jun. 12, 2003

(30) Foreign Application Priority Data

Dec. 3, 2001 (NL) ..... 1019467

(51) Int. Cl.
*A47H 1/00* (2006.01)

(52) U.S. Cl. ..... 160/331; 160/341; 160/346

(58) Field of Classification Search ..... 160/331, 160/346, 347, 345; 16/87.6 R, 95 R, 91, 16/97; 104/89, 93.95, 93, 94, 95; 105/155; 474/255, 257
See application file for complete search history.

(56) References Cited

U.S. PATENT DOCUMENTS 2,507,852 A * 5/1950 Case ..... 474/148
3,117,459 A * 1/1964 Schweitzer ..... 474/205
3,753,457 A * 8/1973 Bratschi ..... 160/331
3,808,483 A 4/1974 Kembuegler et al.
4,492,262 A * 1/1985 Comeau ..... 160/126
4,495,671 A * 1/1985 Comeau et al. ..... 16/87 R
4,958,112 A * 9/1990 Zerillo ..... 318/280
2003/0121622 A1 * 7/2003 Killo et al. ..... 160/331

FOREIGN PATENT DOCUMENTS

EP 0 782 833 A1 7/1997
GB 2 169 189 A 7/1986
JP 3-280907 * 12/1991

* cited by examiner

*Primary Examiner*—Blair M. Johnson
(74) *Attorney, Agent, or Firm*—Merchant & Gould P.C.

(57) ABSTRACT

A device for automatically moving a curtain along a curtain rail, which device comprises driving means movable along the curtain rail, the curtain being adapted to be coupled to the driving means by way of coupling means, wherein the driving means comprise a toothed belt (2). Preferably, the rail (1) is provided with two toothed belt guide channels (1*a*, 1*b*) extending in longitudinal direction of the rail, for the purpose of guiding the toothed belt (2) along the rail (1), the device being provided, adjacent at least a first end of the rail (1), with reversing means (3) for reversing a part of the toothed belt (2) extending out of the one guide channel (1*a*; 1*b*) and guiding it to the other guide channel (1*b*; 1*a*).

2 Claims, 14 Drawing Sheets

DEVICE FOR AUTOMATICALLY MOVING A CURTAIN ALONG A CURTAIN RAIL

Figure 1:
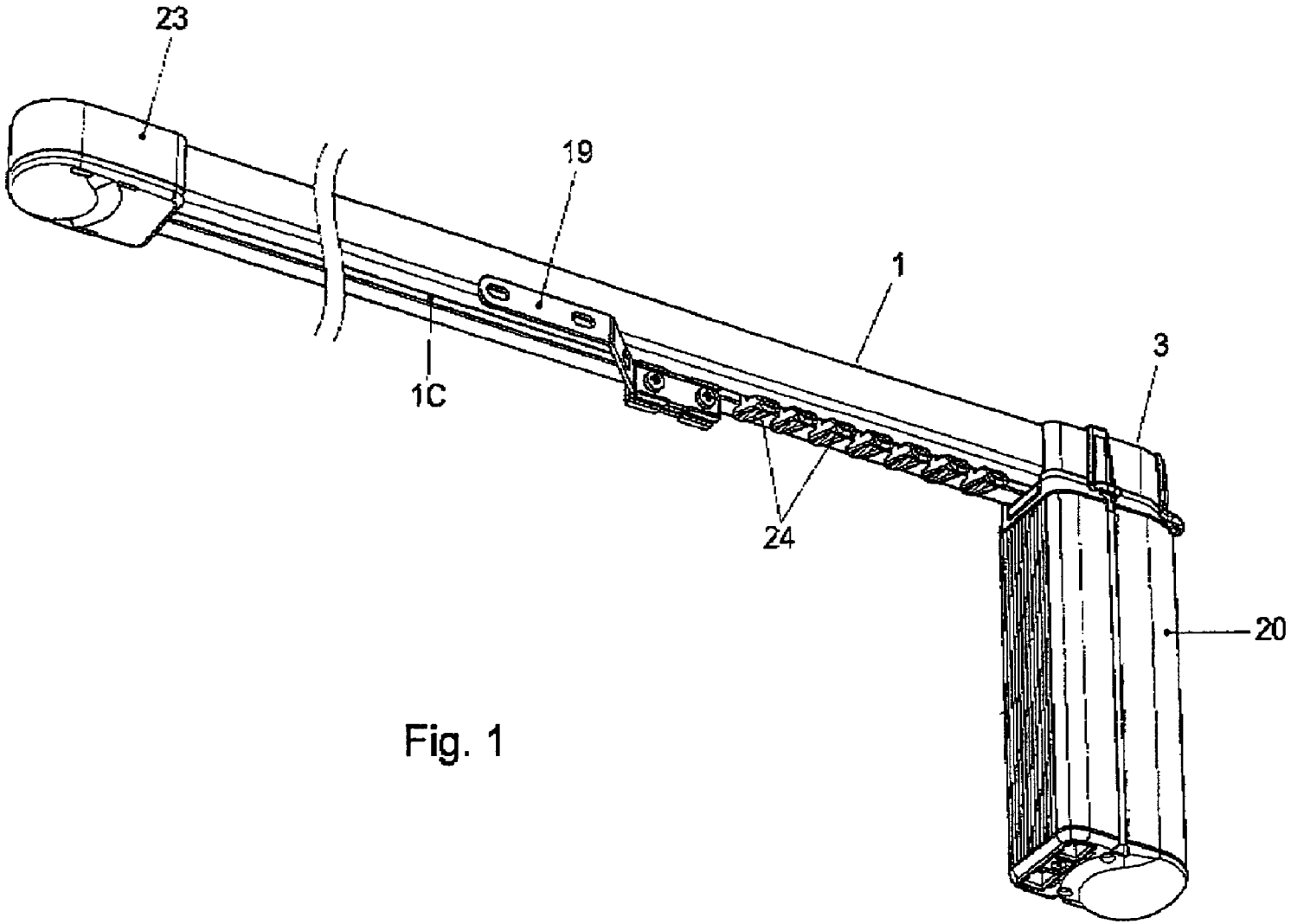

This invention relates to a device for automatically moving a curtain along a curtain rail, which device comprises driving means movable along the curtain rail, the curtain being adapted to be coupled to the driving means by way of coupling means.

Such a device is known from the European patent application EP 0 782 838 A1. With the known device, a curtain can be automatically closed and opened. The curtain is coupled to the driving means by way of coupling means, while the driving means are moved by a drive such as an electric motor.

A drawback of the known device is that the driving means of that device are designed as a flexible driving belt movable along the curtain rail and provided with passages engageable by a gear wheel of the electric motor. As a result of frequent use of such a flexible belt, this belt may become elongated, which may hinder a proper operation of the belt. Moreover, the lift of such a flexible driving belt is usually relatively short. Further, such a driving belt may be under a considerable tension during use. This tension can cause friction and/or deformation at, or of, for instance, means holding and guiding the belt in a desired position. Such deformation can take place in both a stationary condition and a moving condition of the belt. Furthermore, assembling a device provided with such a flexible belt is usually relatively difficult because during assembly the belt is then often to be brought in and/or around belt gelding means of the device under a particular bias.

In practice, automatic curtain rail systems are marketed in which the flexible driving belt comprises a fabric belt impregnated with synthetic resin. Further, from price a driving belt is known which is designed as an extruded all-plastic belt strip. An additional disadvantage of this all-plastic belt strip is that it is relatively rigid and difficult to bend. As a consequence, it takes relatively much energy, for instance, to cause this belt strip to pass through a bend, which energy cannot be usefully employed to cause the curtain to move. Moreover, the plastic belt strip and plastic-impregnated fabric belt are typically subject to creep, for instance when the belt is fitted under a bias and/or during use of the belt under the influence of tensile farces exerted on that belt. As a result of such creep, the bias mentioned decreases and the length of the driving belt increases, which may hinder a proper operation of the belt.

The object of the present invention is to eliminate the disadvantages of the known device. In particular, the invention contemplates a device in which the driving means are relatively durable, while use of the driving means can cause only relatively little wear on other parts of the device.

To that end, the device according to the invention is characterized in that the driving means comprise a toothed belt.

A toothed belt is inherently relatively wear-insensitive, durable and strong. The toothed belt can be simply used in substantially untensioned condition, so that the use thereof has relatively little adverse effect in terms of wear on other parts of the device. In fact, in that case, parts of the device along which the toothed belt has been passed experience substantially none or little of the force coming from the untensioned toothed belt during a stationary condition of that belt, so that those parts, for instance, do not deform, or hardly so, under the influence of such a force. Also when the toothed belt is being moved by, for instance, a drive, the toothed belt will exert substantially little force on other parts of the device, which results in a relatively low wear of the toothed belt itself and a low wear of parts of the device guiding the toothed belt. It will be self-evident that during operation the above-mentioned drive does exert a particular driving force on the toothed belt for the purpose of moving the belt and the coupling means coupled thereto and the curtain. Another advantage of the toothed belt is so that it hardly exhibits any elongation under the influence of such a driving force. As a result, the drive can effect a precise movement of the curtain via the toothed belt. Moreover, a toothed belt is relatively easily bendable in a plane of travel of the toothed belt. As a result, the toothed belt can easily change its direction of travel, for instance to pass through bends. An additional advantage of the toothed belt is that assembly thereof is relatively simple because it does not require the belt to be brought under any, or hardly any, particular bias.

According to a further elaboration of the invention, the rail is provided with two toothed belt guide channels extending in the longitudinal direction of the rail, for the purpose of guiding the toothed belt along the rail, while the device, at least adjacent a first end of the rail is provided with reversing means for reversing a part of the toothed belt that extends out of one guide channel and guiding it to the other guide channel.

Since the toothed belt is passed at the end of the rail from one belt guide channel into the other by the reversing means, the toothed belt can extend substantially wholly in the rail. As a consequence, said first end of the rail can, for instance, be positioned relatively close to an obstacle, such as a wall, during assembly of the device. Since the toothed belt after assembly is normally substantially untensioned, and is relatively easily bendable, the reversing means sustain relatively little wear resulting from the reversal of the toothed belt from one guide channel to the other. Further, the toothed belt will inherently offer relatively little bending resistance to said reversal, so that the reversing means can effect this reversal easily, with relatively little force. The reversing means can comprise, for instance, a reversing bearing along which the toothed belt has been passed fox a bearing-supported reversal of the toothed belt. Since the reversing bearing is intended to reverse a substantially untensioned toothed belt, the bearing can be made of particularly simple and cheap design, with relatively few parts moving during use, specifically when compared with the bearings known from practice, such as ball bearings for bearing-supporting and reversing driving means under tension.

According to a further elaboration, the device is provided with a rotatable driving means provided with a toothing, which is so disposed that the toothing of the driving means engages a toothing of the toothed belt for the purpose of driving the toothed belt through rotation of the driving means. This driving means can effect a powerful drive of the toothed belt, to which end the driving means may for instance be coupled to a motor. It is advantageous when the reversing bearing comprises a bearing house in which at least the toothed part of the driving means is rotatably disposed, while the bearing house is arranged to pass the toothed belt from the toothed belt guide channels to the toothing of the driving means for the purpose of the drive referred to. The reversing bearing can thus be made of very simple, cheap and relatively light design, which is favorable with regard to the price of the device. Moreover, the reversing bearing can in this way be made relatively compact, which is advantageous from an assembly point of view and is desirable in connection with esthetic considerations. The end of the rail at which the reversing bearing is situated can be mounted relatively close to, for instance, a wall of a room in which the curtain is to be hung. As a consequence, the curtain can extend virtually completely from wall to wall in the room, while the reversing bearing can be concealed from view. The bearing house is preferably manufactured substantially from plastic. Also the toothed driving means is preferably manufactured from plastic. The driving means may be provided with two journal which are bearing-supported in a reversing bearing designed as a slide bearing. Plastic is cheap and has been found capable of effecting a very good, low-friction bearing of the toothed belt, which is advantageous in connection with an additionally low wear of the toothed belt and the bearing house.

According to an advantageous elaboration of the invention, the bearing house is shaped such that the driving means and inner walls of the bearing house facing that driving means enclose the part of the toothed belt that is to be reversed, substantially free from play.

Thus, the bearing house and the driving means can bearing-support the toothed belt in a simple manner, whilst avoiding the toothing of the toothed belt slipping along the toothing of the driving means.

Preferably, the bearing house and/or the toothed driving means is/are manufactured by means of an injection molding process.

By injection molding the bearing house and the toothed driving means, respectively, this part can be manufactured cheaply and with high precision.

Further elaborations of the invention are described in the subclaims.

Figure 2A:
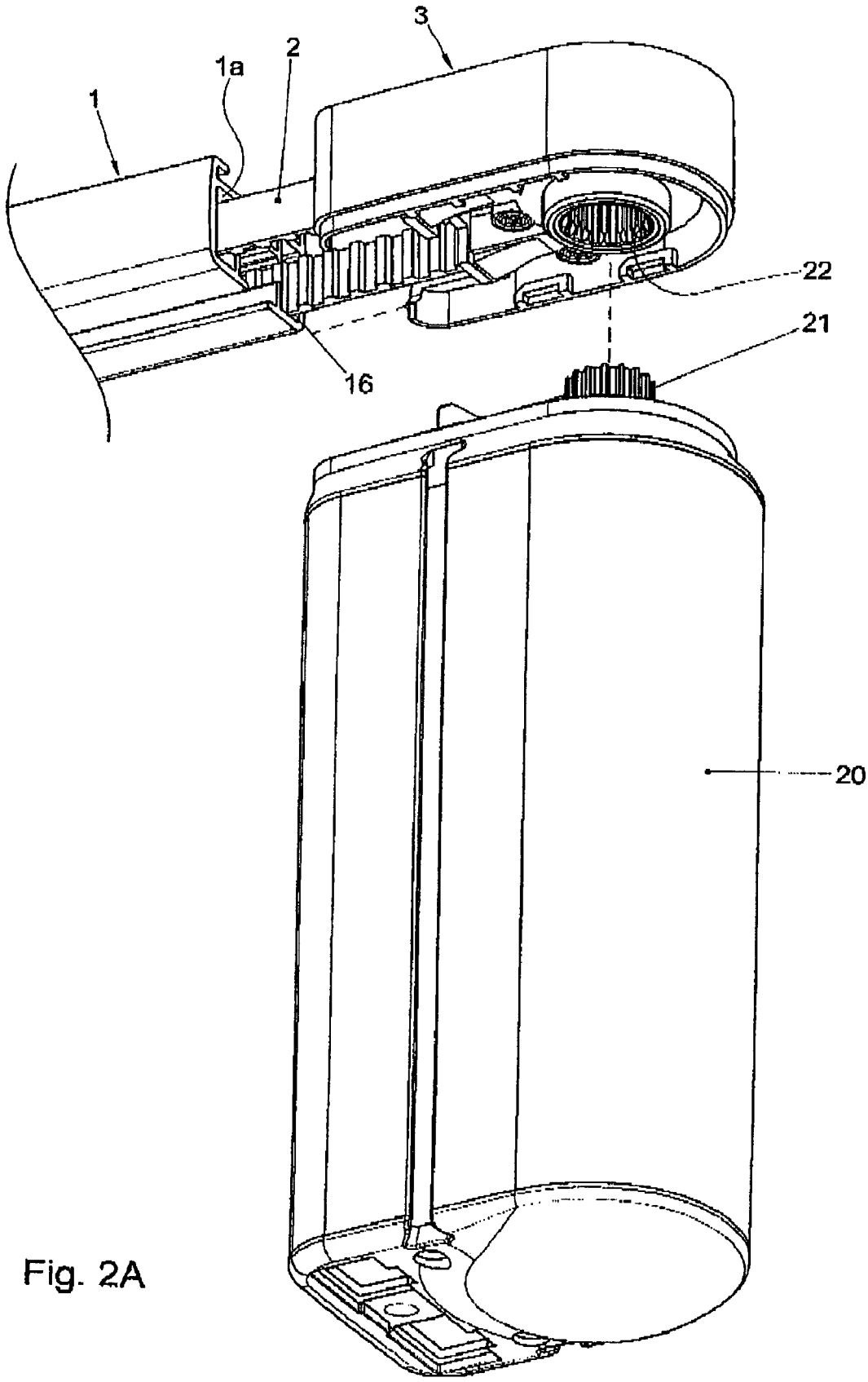
Figure 2B:
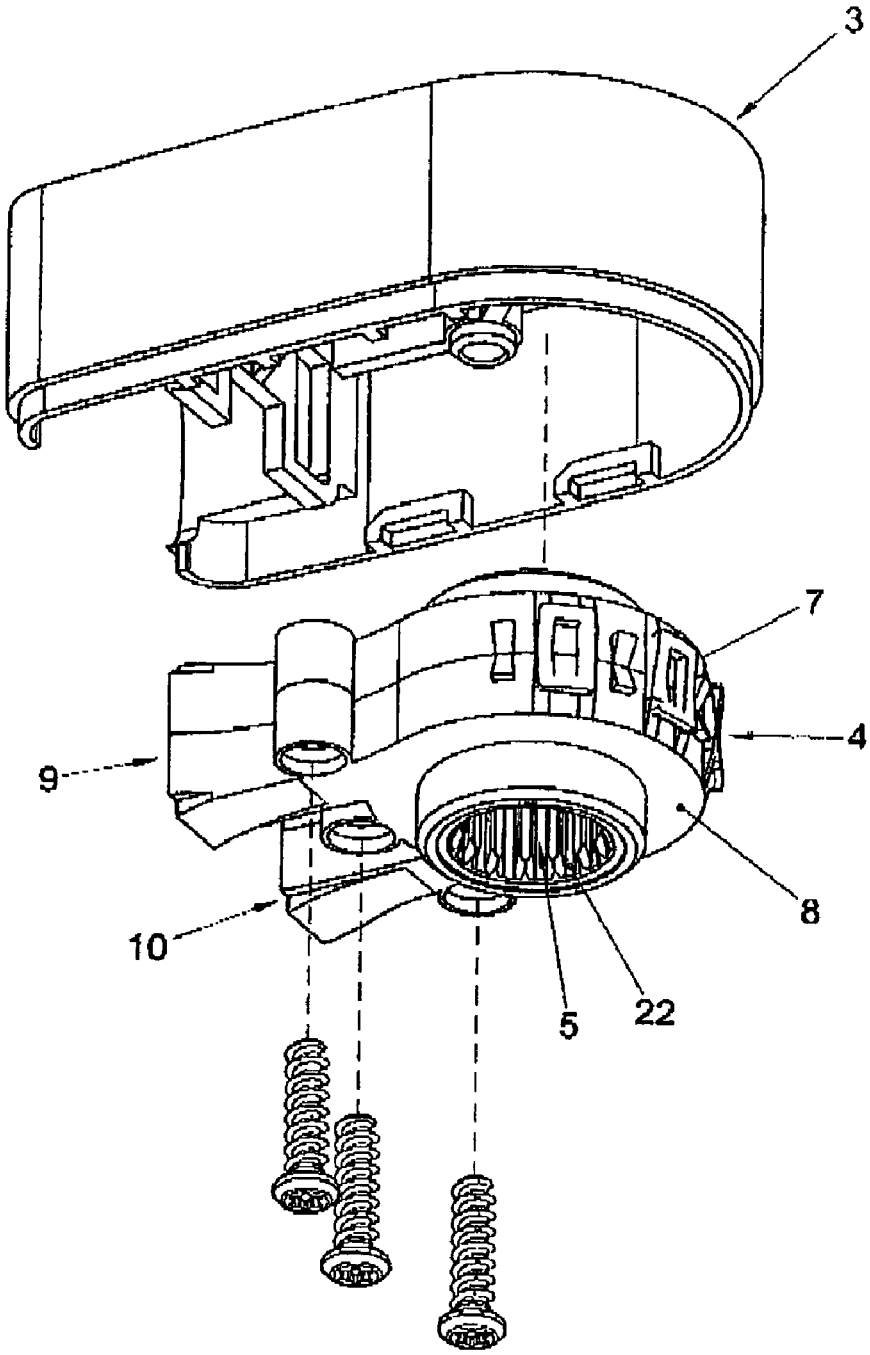
Figure 2C:
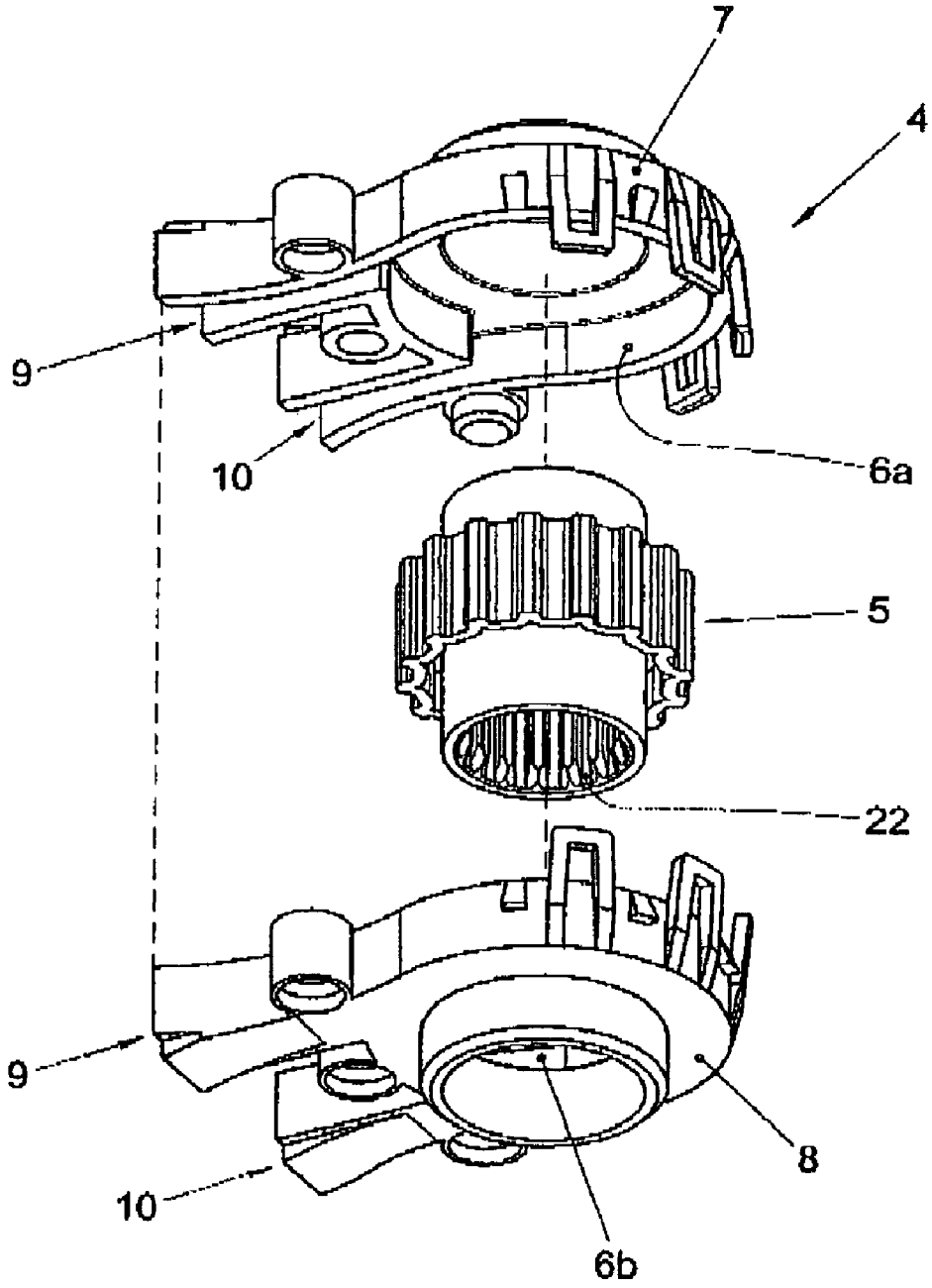
Figure 4A:
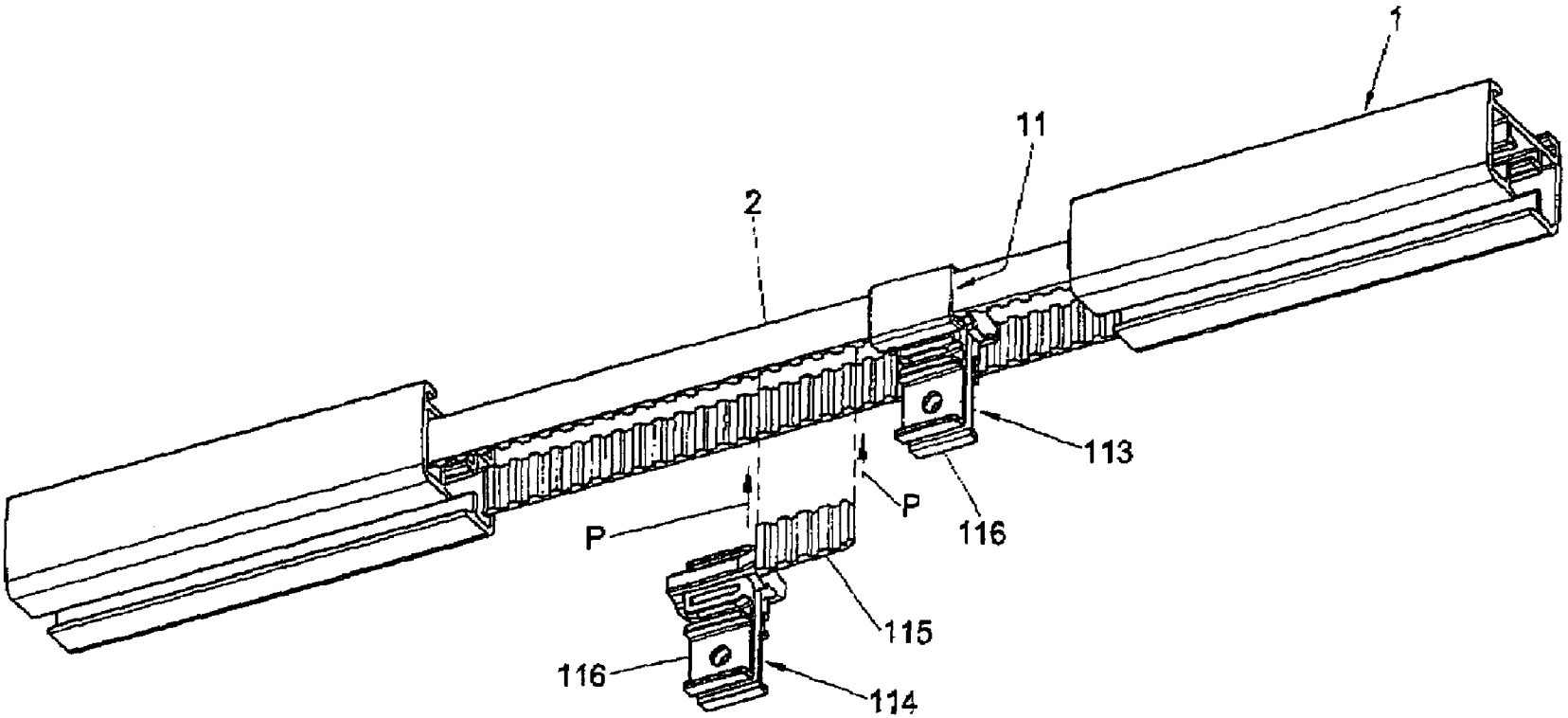
Figure 4B:
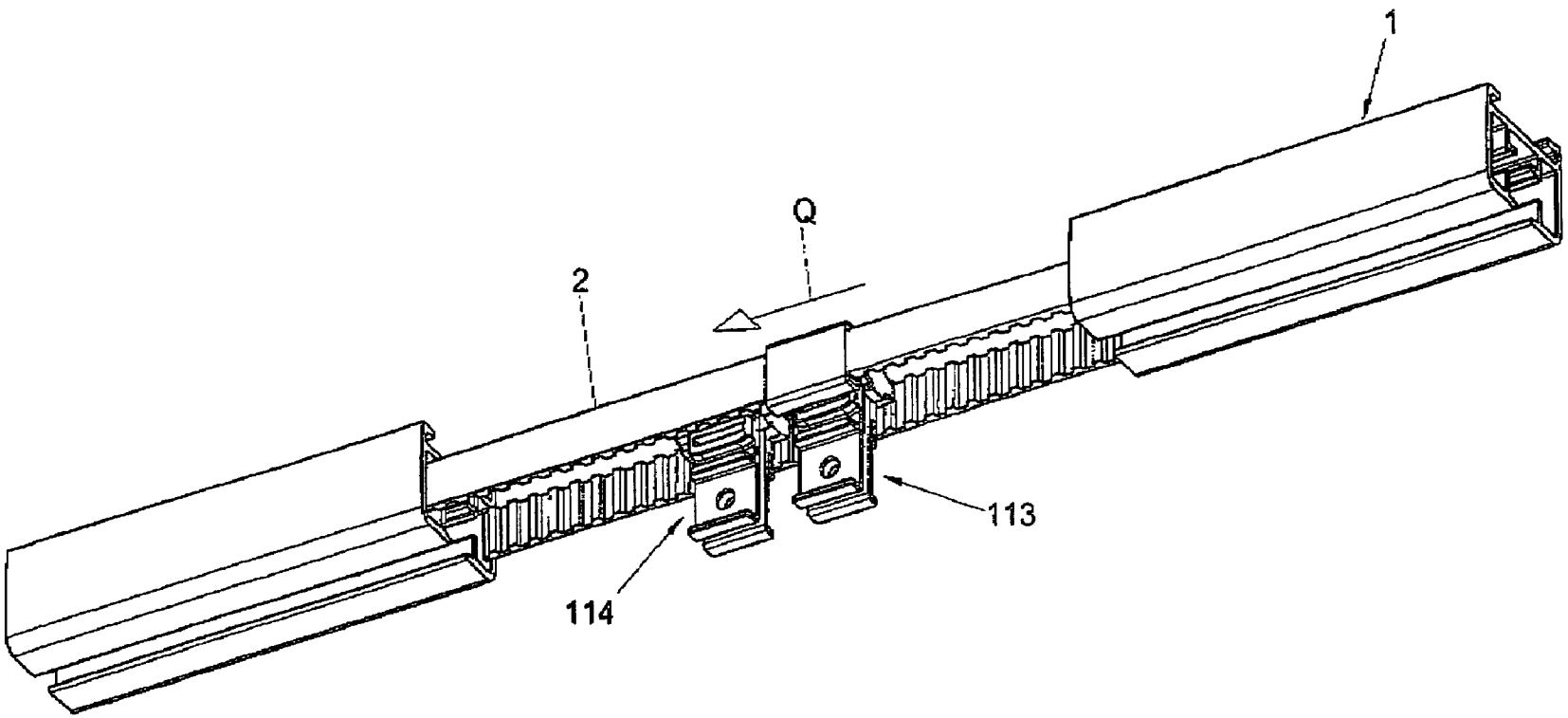
Figure 4C:
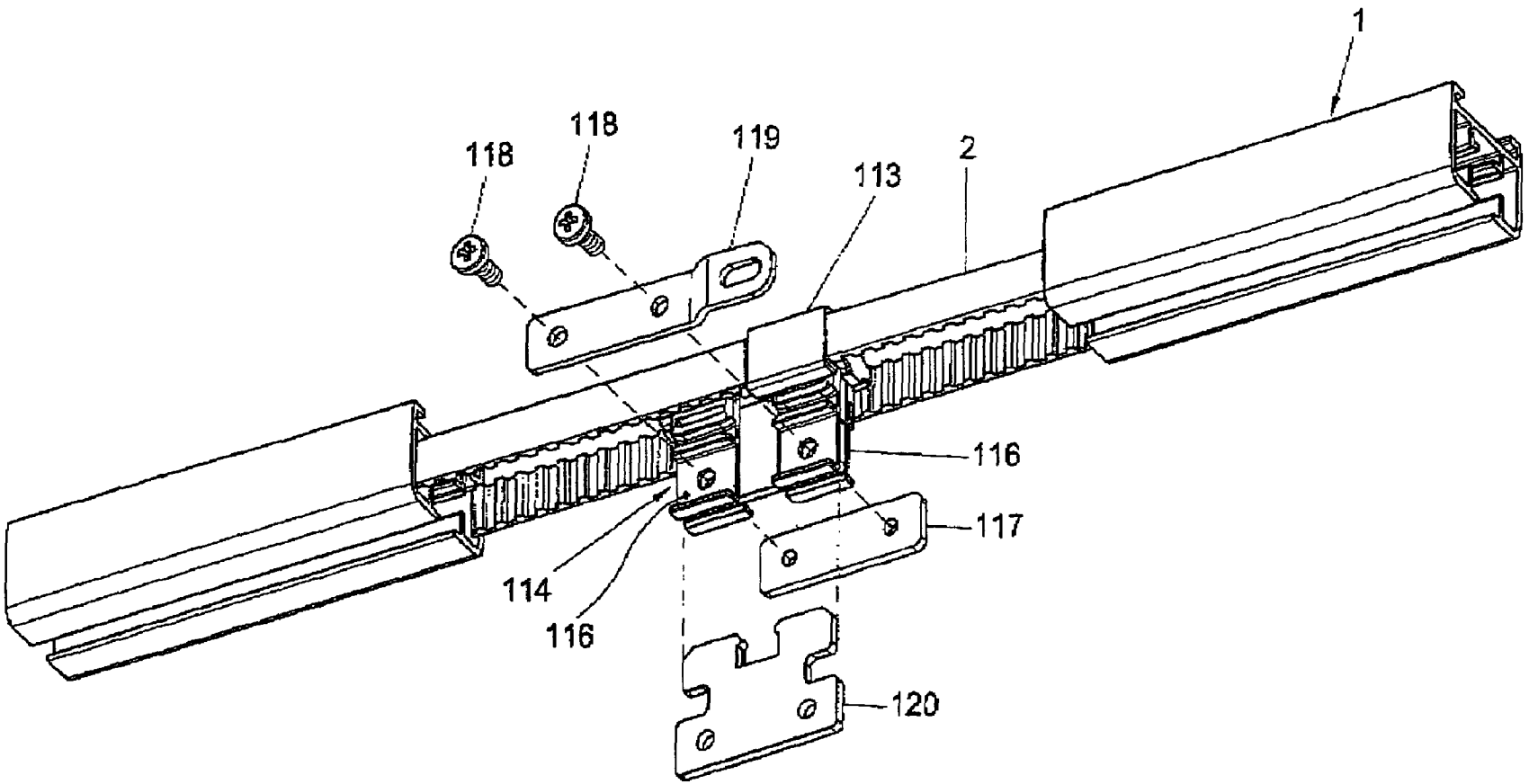
Figure 5:
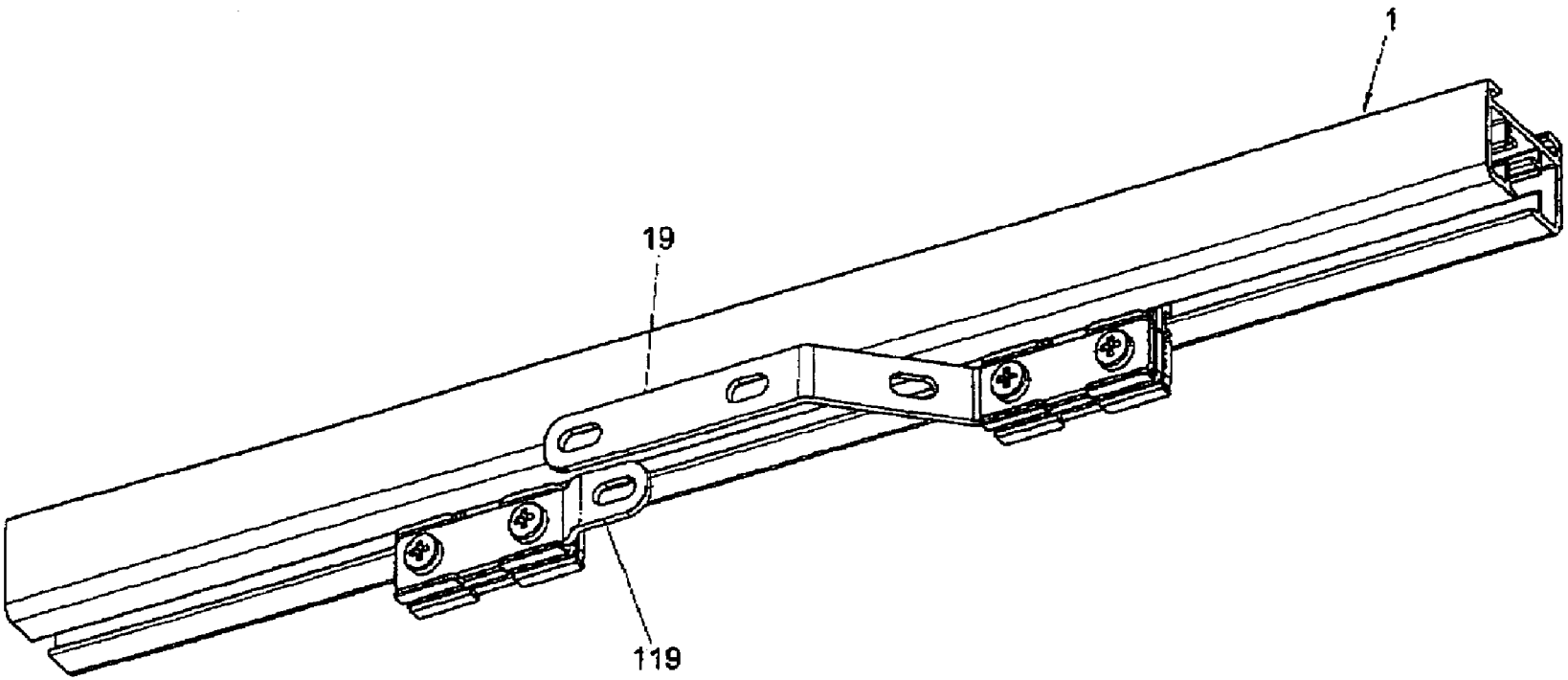

The invention will presently be described with reference to an exemplary embodiment from the drawing. In the drawing:

FIG. 1 shows a perspective view of an exemplary embodiment of the invention;

FIGS. 2*a*-2*c* show a reversing bearing situated adjacent an end of the rail and a drive of the exemplary embodiment represented in FIG. 1;

FIGS. 3*a*-3*f* show a number of assembly steps of the assembly of a toothed belt closure and a curtain coupling of the exemplary embodiment represented in FIG. 1;

FIGS. 4*a*-4*c* show a number of assembly steps of the assembly of an adjustable curtain coupling of the exemplary embodiment represented in FIG. 1; and FIG. 5 shows an exemplary embodiment of the invention, provided with two curtain coupling hooks.

The figures show a device for moving a curtain along a curtain rail. For clarity, the curtain is not represented in the drawings. The device is provided with a curtain rail 1. As FIG. 1 shows, the rail 1 is provided with a so central running surface which is arranged to guide a number of sliders 24 in the longitudinal direction of the rail 1. FIG. 2*a* shows that the rail 1 is further provided with two toothed belt guide channels 1*a*, 1*b* extending parallel to the central running surface 1*c*, for guiding a toothed belt 2. This toothed belt 2 is connected in the rail 1 to a curtain coupling hook 19 by means of coupling means 13-18, which are represented in more detail in FIGS. 3*a*-3*f*. Opposite ends of the rail 1 are provided with a first and a second reversing bearing 3 and 23, respectively, for the purpose of reversing the toothed belt 2. Further, the device is provided with a drive 20, for instance an electric motor, for the purpose of driving the toothed belt 2. The drive 20 is coupled to the first reversing bearing 3, which is attached to the first end of the rail 1. In the present exemplary embodiment, the drive 20 is a low-voltage motor, such as a 24V motor, which further includes a control for operating the motor. To the control, there can be coupled, for instance, a remote control, such as a radiographic and/or infrared receiver, a computer, a control of another device for automatically moving a curtain, and/or the like, for the purpose of regulating control parameters, such as, for instance, a curtain speed, curtain run-in/run-out speed, a force to be exerted on the curtain, and like parameters.

As FIGS. 2*a*-2*c* show, the toothed belt 2 has been passed through the first reversing bearing 3 for reversing the toothed belt 2. The toothed belt 2 is easily reversible because the toothed belt 2 inherently offers relatively little bending resistance, at least in the plane of travel of the toothed belt, which plane of travel extends through the two toothed belt guide channels 1*a*, 1*b*. The reversing bearing 3 is provided with a rotatable toothed driving mean 5 and a bearing house 4. The driving means is so disposed within the toothed belt 2 that the toothing of the driving means 5 engages an inwardly facing toothing of the toothed belt 2 for the purpose of driving the toothed belt 2 through rotation of the driving means 5. The driving motor 20 is, at least during assembly, coupled by means of a star key—tooth connection 21, 22 to the tooted driving means 5. FIGS. 2*a*-2*c* further show that at least the toothed part of the driving means 5 is rotatably arranged in the bearing house 4 during assembly of the device. The bearing house 4 is provided with two passages 9, 10 for passing the toothed belt 2 from the toothed belt guide channel 1*a*, 1*b* to the tooted part of the driving means 5 forte purpose of the drive referred to. The bearing house 4 in the exemplary embodiment shown is shaped such that the driving means 5 and inner walls 6*a*, 6*b* of the bearing house 4 facing that driving means 5 enclose the part of the toothed belt to be reversed, substantially free from play.

FIGS. 2*b* and 2*c* show that the bearing house 4 comprises a first bearing house part 7 and a second bearing house part 8, connected with the first bearing house part 7. These parts 7, 8 can be manufactured, for instance, by means of a plastic injection molding process.

The toothed belt is preferably mounted in the rail 1 such that the toothed belt 2 is substantially untensioned. As a result, the toothed belt 2, in both stationary and moving condition, can exert relatively little force on at least the reversing bearings 3, 23, which results in a relatively low wear and deformation of these reversing bearings 3, 23.

Figure 3A:
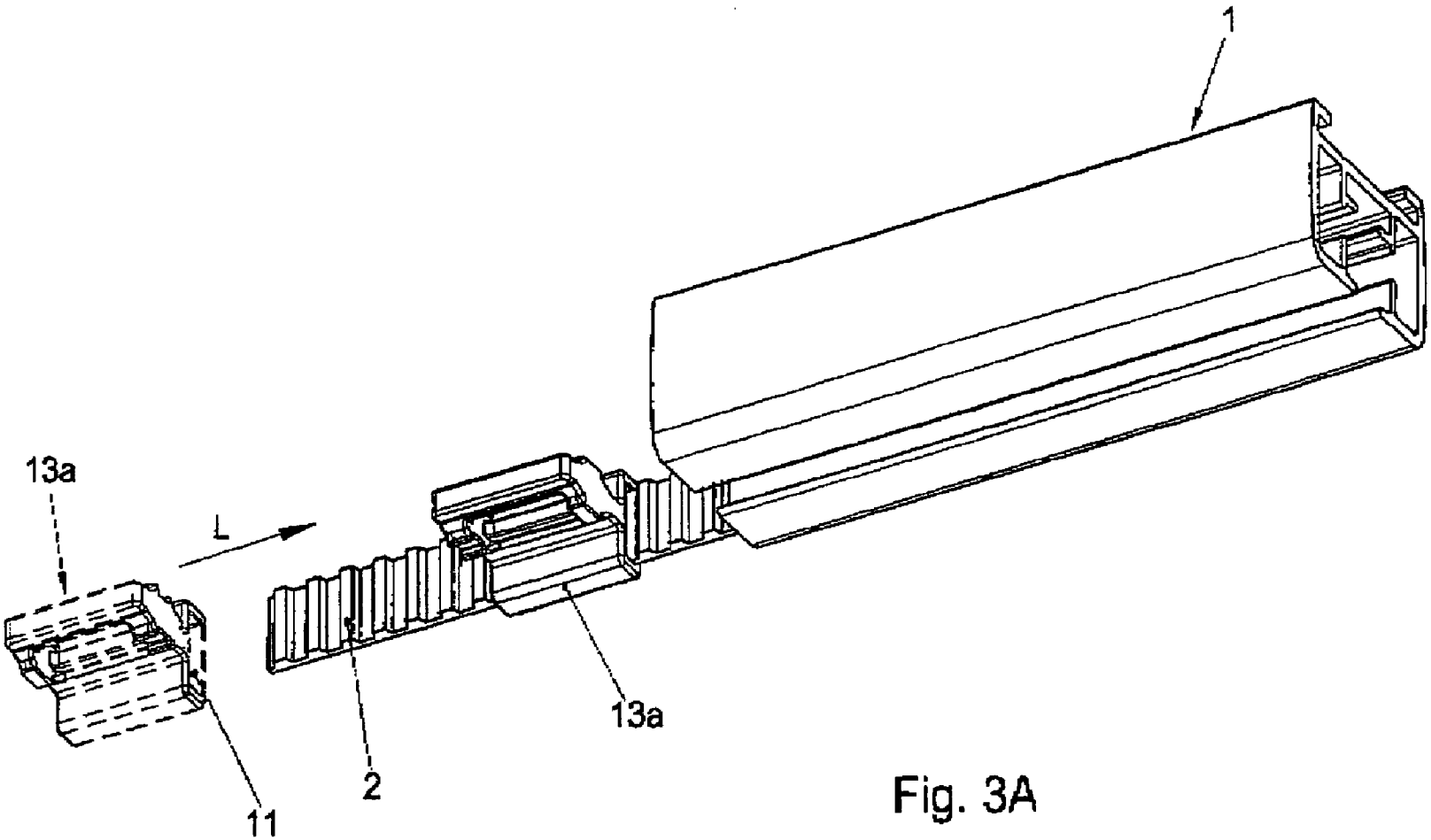
Figure 3B:
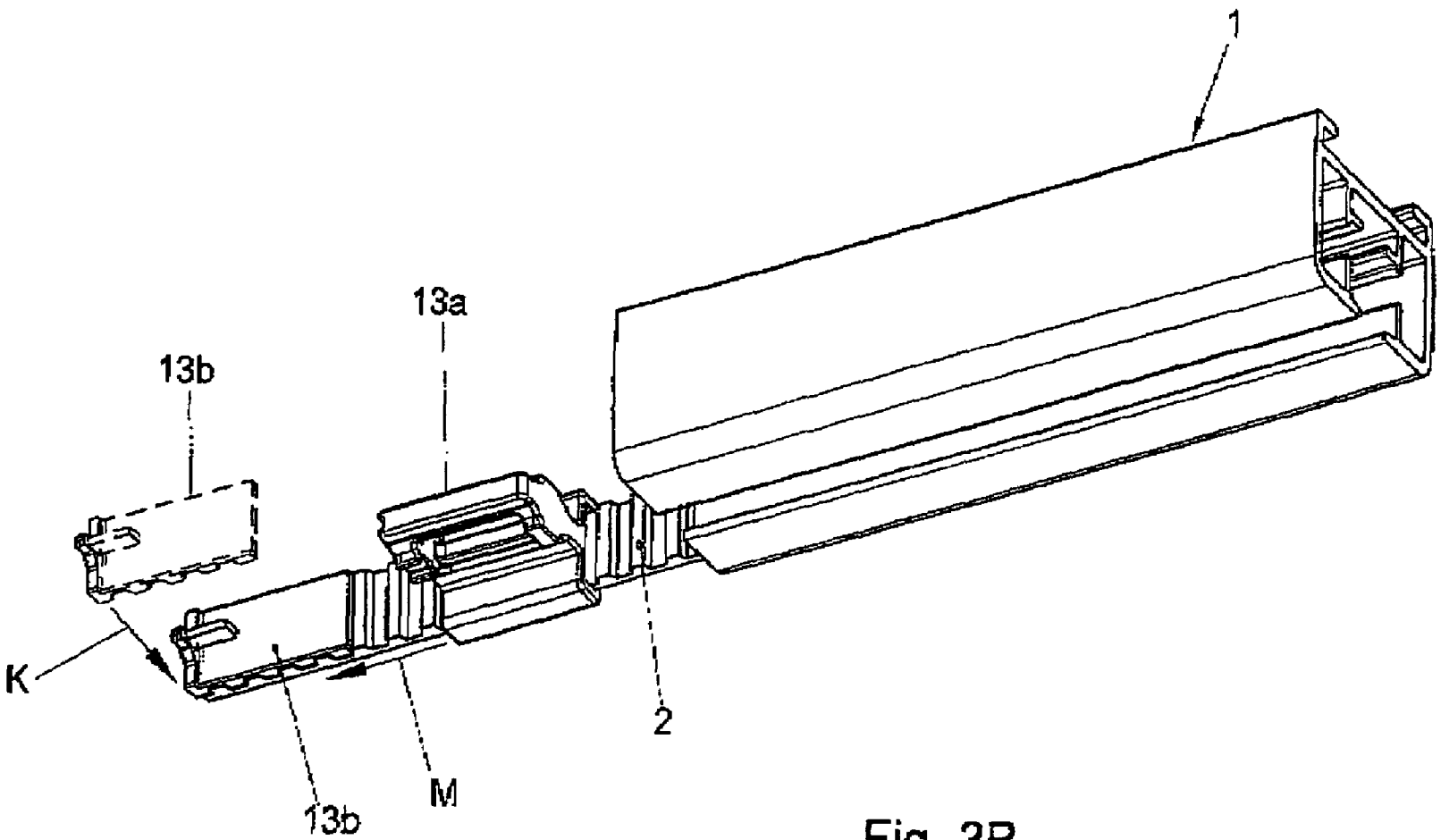
Figure 3C:
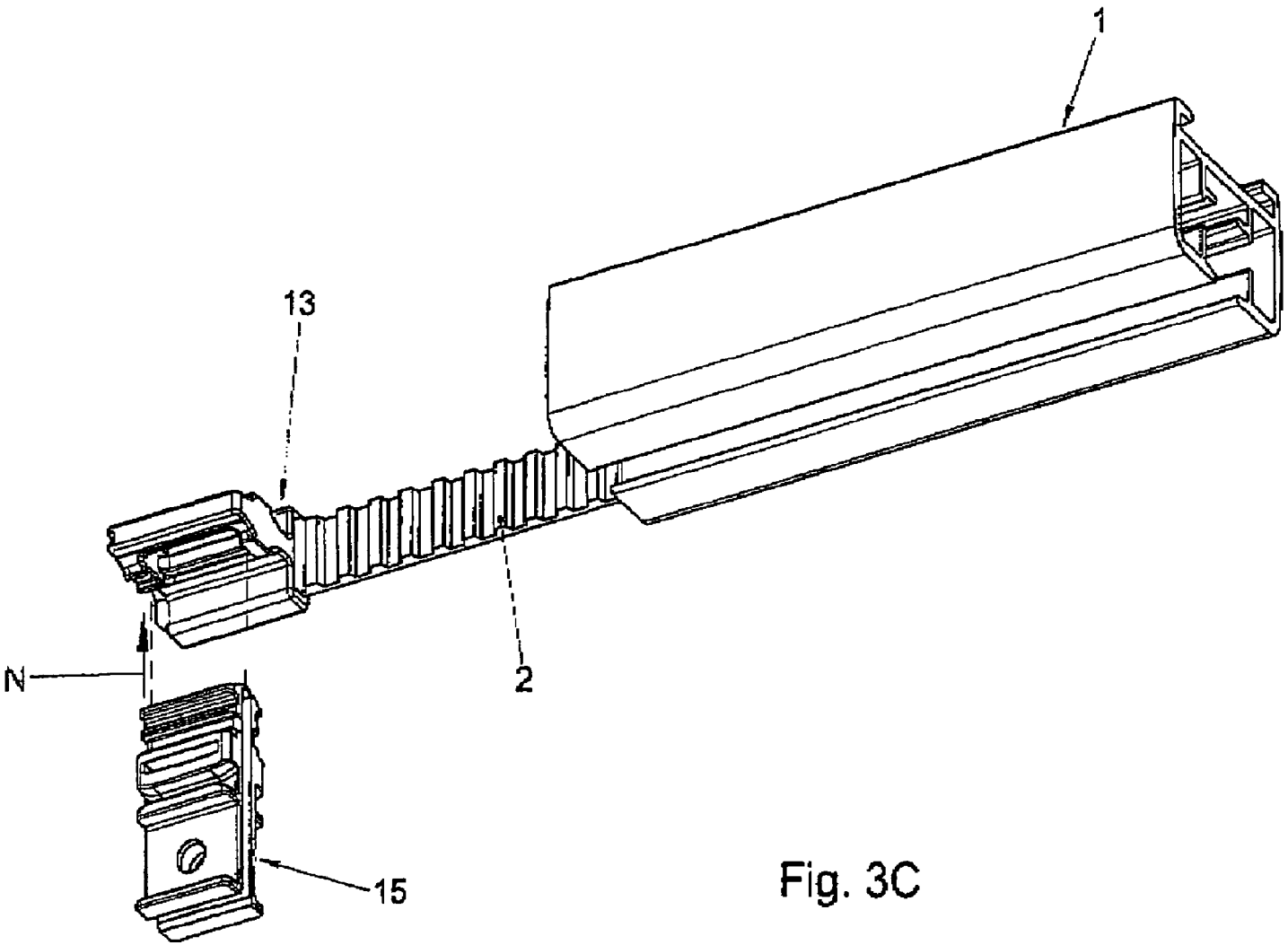
Figure 3D:
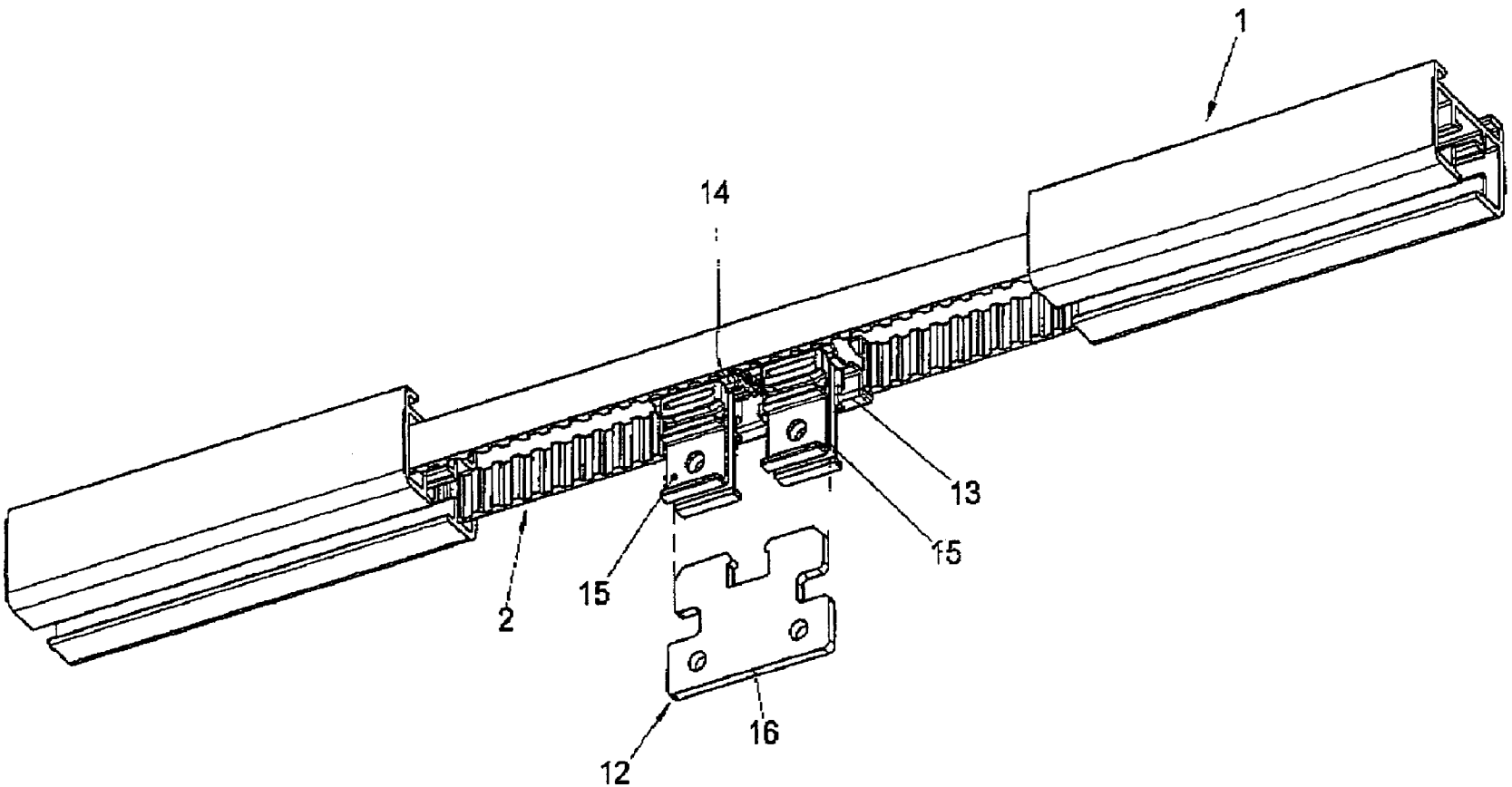
Figure 3E:
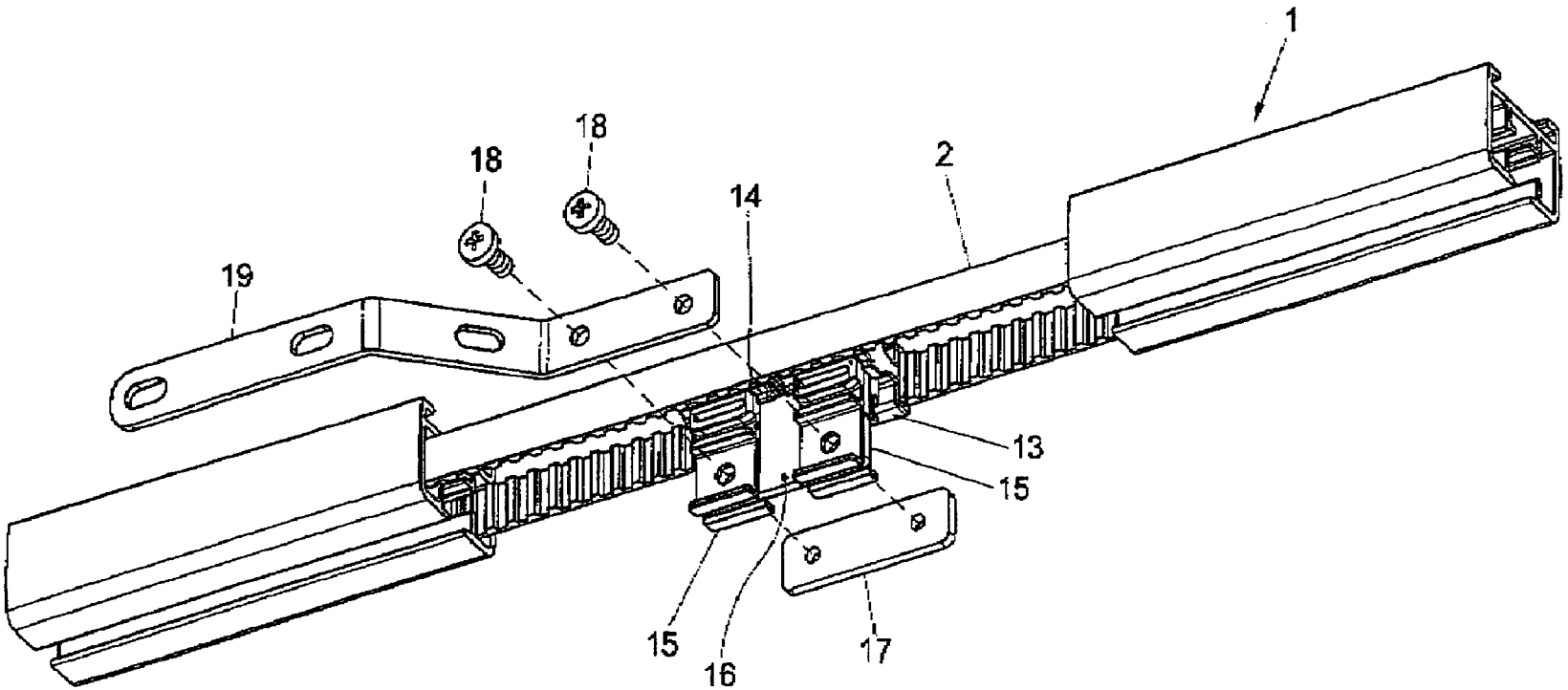
Figure 3F:
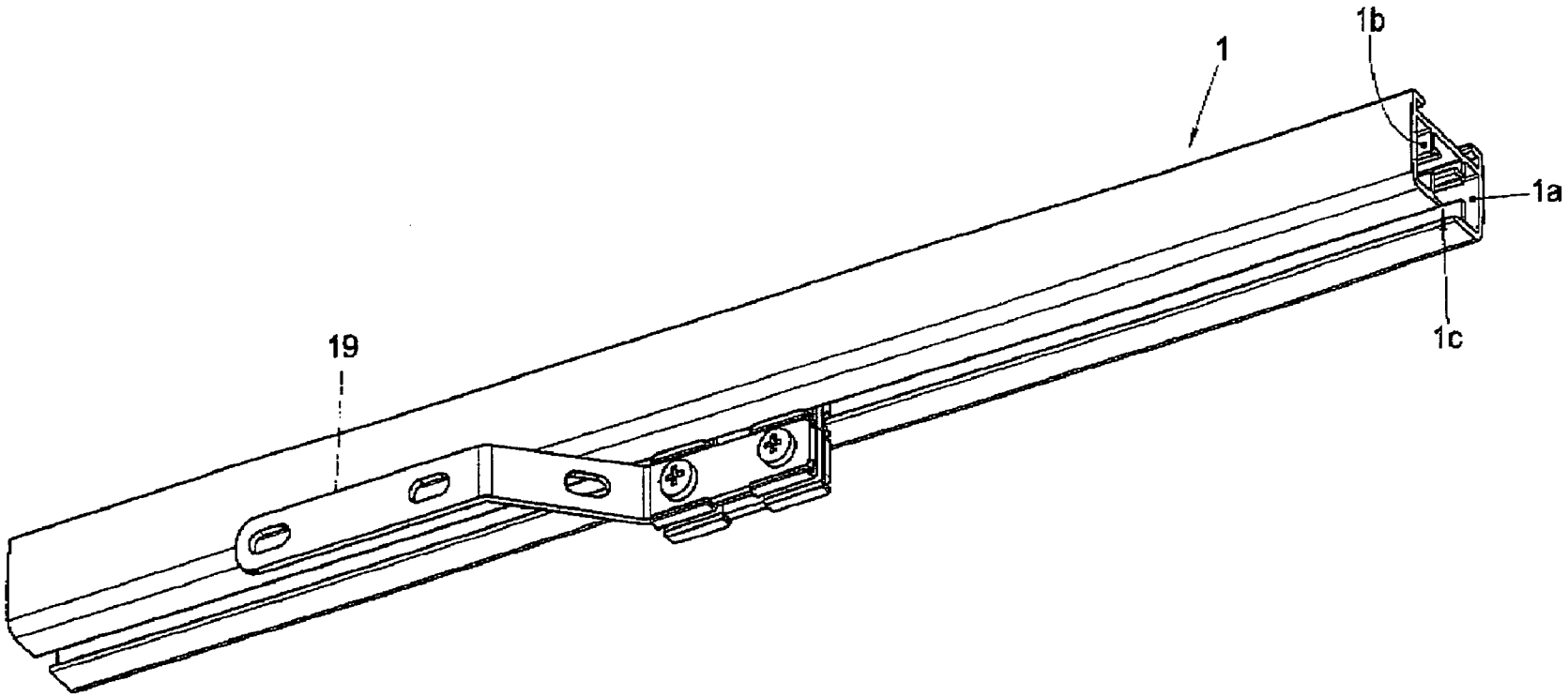

The tooted belt 2 is closed in itself through a closure 12. As FIG. 3 shows, this closure is provided with, preferably injection molded, plastic clamping parts 13*a*, 13*b*, 14 engaging the toothing of the belt 2 and attached to each other by means of fastening means 15, 16, 17, 18. FIG. 5*a* shows a first step for assembling the closure of the toothed belt 2, whereby a first clamping part 13*a* is slipped onto the toothed belt 2 in the direction of arrow L. Clamping part 13*a* is provided with an eye 11, rectangular in cross section, through which the toothed belt 2 is inserted. As FIG. 3*b* shows, next, a clamping lip 13*b* is placed on the toothing of the toothed belt 2, which is represented with arrow K. This clamping lip 13*b* comprises a wedge-shaped part provided on one side with a toothing engaging the toothed belt 2. Then the first clamping part 13*a* is slid back in the direction of arrow M, thereby clamping itself fixedly onto the clamping lip 13*b* as a result of the wedge shape of that clamping lip 13*b*. FIG. 3*c* shows that, next, a first fastening body 15 is attached to the clamping parts 13, which is indicated by means of arrow N. An opposite end of the toothed belt 2 is provided with a second clamping part 14 and a fastening body 15 in the same manner as described with reference to FIGS. 3*a*-3*c*. The two ends of the tooted belt 2 are subsequently connected to each other by means of a fastening plate 16, screws 18 and a screw plate 17 via the fastening bodies 15, which is represented in FIGS. 3*d* and 3*e*. FIGS. 3*e* and 3*f* further show that the closure is provided with the above-mentioned curtain coupling hook 19, to which a curtain can be coupled during use.

FIGS. 4*a*-4*c* represent a number of steps of the assembly of a second curtain coupling hook 119, adjustable along the toothed belt 2. As FIG. 4*a* shows, the toothed belt 2 to that end is provided with a third clamping part 113 which has a rectangular eye 111 enclosing the toothed belt 2, such that the clamping part 113 can be slid along the toothed belt 2. Next, a fourth clamping part 114 with a toothed clamping lip 115 is placed on the toothing of the toothed belt 2, which is indicated with arrows P. The toothed clamping lip 115 of the fourth clamping part 114 is wedge-shaped. As FIG. 4*b* shows, the third clamping part 113 is thereupon slid back in the direction of arrow Q, thereby clamping itself fixedly onto the clamping lip 115 of the fourth clamping part 114 as a result of the wedge shape of that clamping lip 115. The third and fourth clamping parts 113, 114 are each provided with a fastening body 116. As is represented in FIG. 4*c*, the third and fourth clamping parts 113, 114 can be attached to each other and to the second curtain coupling hook 119 by means of a fastening plate 120, screws 118 and a screw plate 117.

FIG. 5 shows a design of the device which is provided with both the first coupling hook 19, connected to the curtain closure, and the second coupling hook 119, adjustable along the curtain rail 1, so that two curtains can be driven with a single driving system.

Since the toothed belt 2 inherently exhibits relatively little elongation, the drive 20 can effect an accurate displacement of the curtain via the toothed belt 2 during use. The elongation referred to concerns both elastic stretch and plastic elongation. Therefore the toothed belt 2, during use, can maintain substantially a length by which the toothed belt fits into the guide channels and the reversing bearings. As a result, a desired smooth guidance of the toothed belt 2 along the guide channels and reversing bearings can be maintained for a long period of use, without that guidance being disturbed by an undesired plastic elongation of the toothed belt. It will be clear that the invention is not limited to the exemplary embodiment described, but that various modifications are possible within the framework of the invention as set forth in the following claims.

For instance, the second reversing bearing 23 can be designed in the same manner as or in a different manner than the first reversing bearing 3.

By virtue of the closure being of detachable design, the tooted belt 2 can be shortened relatively easily and the position of a curtain coupling hook fitted on the other toothed belt run can be easily varied.

The invention claimed is:

1. A device for automatically moving a curtain along a curtain rail comprising:

driving means movable along the curtain rail, wherein the driving means includes:

a toothed belt, the toothed belt having two ends connected to each other through a closure so that the toothed belt is endless;

wherein the closure is detachable and provided with first and second clamping parts, wherein each of the first and the second clamping parts are separately mountable to one of the ends of the toothed belt and are subsequently interconnectable so as to form the closure, wherein the closure is provided with a first coupling hook configured for coupling to a curtain:

a third clamping part having an eye enclosing the toothed belt, such that the third clamping part can be slid along the toothed belt, a fourth clamping part having a toothed clamping lip which is wedge-shaped, wherein the third clamping part in a slid back position is clampingly fixed onto the clamping lip of the fourth clamping part as a result of the wedge shape of the clamping lip, so that the third and fourth clamping parts are connected at a desired position onto the toothed belt, and a second coupling hook connectable to the third and the fourth clamping part adapted for coupling a second curtain to the third and the fourth clamping part.

2. A device for automatically moving a curtain along a curtain rail comprising:

driving means movable along the curtain rail, wherein the driving means includes:

a toothed belt, the toothed belt having two ends connected to each other through a closure so that the toothed belt is endless;

wherein the closure is detachable and provided with first and second clamping parts, wherein each of the first and the second clamping parts are separately mountable to one of the ends of the toothed belt and are subsequently interconnectable so as to form the closure, wherein the closure is provided with a first coupling hook configured for coupling to a curtain;

wherein the first clamping part is provided with an eye through which the toothed belt is insertable, the first clamping part further comprising a separate clamping lip having a wedge shaped part on one side with toothing engaging the toothed belt, wherein the eye of the first clamping part is constructed to be slid back over the clamping lip to fixedly clamp the first clamping part onto the toothed belt as a result of the wedge shape of the clamping lip;

wherein the second clamping part is provided with an eye through which the toothed belt is insertable, the second clamping part further comprising a separate clamping lip having a wedge shaped part provided on one side with toothing engaging the toothed belt, wherein the eye of the second clamping part is constructed to be slid back over the clamping lip to fixedly clamp the second clamping part onto the toothed belt as a result of the wedge shape of the clamping lip.

* * * * *